United States Patent [19]

Malo

[11] 3,934,785

[45] Jan. 27, 1976

[54] METHOD OF ASSEMBLING BOXCAR END STRUCTURE

[75] Inventor: Lowell L. Malo, St. Peters, Mo.

[73] Assignee: ACF Industries, Incorporated, New York, N.Y.

[22] Filed: Aug. 26, 1974

[21] Appl. No.: 500,787

Related U.S. Application Data

[62] Division of Ser. No. 421,462, Dec. 3, 1973, Pat. No. 3,866,546.

[52] U.S. Cl. ..... 228/135; 29/469

[51] Int. Cl.[2] ..... B23K 31/00

[58] Field of Search ..... 29/469, 470, 470.5; 105/410

[56] References Cited

UNITED STATES PATENTS 3,123,018 3/1964 Radey ..... 105/410 X

*Primary Examiner*—James L. Jones, Jr.
*Assistant Examiner*—Margaret Joyce
*Attorney, Agent, or Firm*—Henry W. Cummings

[57] ABSTRACT

A box car end is provided having an offset portion. A box car flat end liner is affixed to the end on the side opposite the offset portion. The assembled liner and end are placed in engagement with an end sill having a horizontal portion extending inwardly toward the car and a vertical extension at the end thereof. The offset portion is integrally affixed to the end sill vertical extension, preferably with mechanical fasteners. A floor support is integrally affixed to the horizontal portion of the end sill. The floor support has a horizontal portion supporting a portion of the car floor and an upper vertical portion providing an unobstructed end area on the inside of the car. The upper vertical portion of the floor support may be integrally affixed, preferably by welding to either the end and/or the flat end liner, preferably above the offset portion.

6 Claims, 5 Drawing Figures

METHOD OF ASSEMBLING BOXCAR END STRUCTURE

This is a division of application Ser. No. 421,462, filed Dec. 3, 1973, now U.S. Pat. No. 3,866,546 issued Feb. 18, 1975.

FIELD OF INVENTION

This invention relates to box car end structures. In particular, it relates to an improved box car end structure and fabrication technique thereof which is easier to assemble and results in cost savings.

BACKGROUND OF THE INVENTION

In accordance with a common construction of the prior art, a box car end 10 is provided with an offset portion 12 and a corrugated portion 14, usually of steel construction. The box car end 10 is welded to a flat metal end liner 20 leaving a space 22 between liner 20 and offset portion 12. The assembly of liner 20 and end 10 is then suspended by means of appropriate overhead crane means (not shown) and is brought above the floor portion of the box car indicated generally at 30. Already in place and comprising the lower or floor portion of the car is an end sill 32 comprising a generally horizontal portion 34 and a generally vertically extending portion 36. Welded or otherwise appropriately affixed to end sill 32 is a floor panel support member 40. Panel support member 40 comprises a lower generally vertically extending portion 42 and a generally horizontally extending portion 44 which is welded to end liner 20 at 43 and supports on its upper surface a floor panel member 48. Floor panel member 48 extends along horizontal portion 44 of floor panel support 40 but terminates at a point 50 wherein it is welded or otherwise affixed to horizontal portion 44 leaving a space or gap 52.

However, prior to welding the panel support to the end sill and the panel to the panel support, in order to obtain engagement of the end and end liner assembly with the end sill 32 it is necessary to lower the end and end liner assembly and in such a way as to have the vertical portion 36 of the end sill enter into the opening 22 defined by offset 12 and flat end liner 20. This is a difficult operation. It is often time consuming and occasionally dangerous.

In order to provide an unobstructed end area 51, countersunk fasteners, for example, huck bolts 58 are usually utilized to hold the liner and end in engagement with the vertical extension of the end sill. The countersinking of the end liner and extension 36 indicated respectively at 54 and 56 and the drilling of holes 57 in offset portion 12 is done prior to lowering the end and end liner over the end sill extension. However, it often occurs that there is misalignment between the countersunk holes 54 in the end sill as compared with holes 56 in the end liner and/or holes 57. As a result it is often necessary to recountersink in order to put the fasteners in place. This is a time consuming operation and when a whole assembly line may be held up with such operations, the expense is greatly multiplied.

In another construction shown in FIG. 3 a fastener 59 is utilized to hold the end 10 and liner 20 in engagement with the end sill 32 and vertical extension 36. The fastener is not countersunk and the head 59a extends into the car so that when the horizontal portion 44 of the floor panel support is welded to the liner 20 an inwardly inclined extension **44*a* is provided which provides an obstruction in the car which can damage lading and/or make it difficult to pack in the end area 51** of the car.

Another prior art construction utilizes a corrugated end liner in which mechanical fasteners are placed between or below the corrugations which hold the end sill vertical extension in engagement with the offset portion of the end. A panel support is welded to the horizontal portion of the end sill and to the lower portion of the corrugations and/or the vertical extension of the end sill. However, in this construction the end of the car is obstructed to the extent of the corrugations. Also, the corrugations may damage some ladings. Furthermore, a corrugated end is weaker than a flat steel end, particularly with regard to bending applied longitudinally to the end of the car.

Still another prior art construction is shown in FIG. 4 wherein the end 10 and the flat end liner 20 are integral throughout the lateral extent of the car. The end has no offset 12 and a weld, for example, as shown at 11 holds the members together. This construction does avoid the obstructions in the end area such as **44*a* in FIG. 3 and the countersunk construction in FIG. 2**. However, many customers are opposed to an integral end and end sill because if the end of the car is damaged the entire car end structure must be disassembled, for example, by torch burning, resulting in considerable expense and downtime to repair the car. For this reason the integral end and end sill construction is not desired by many customers.

It therefore is an object of the present invention to provide a box car end construction which leaves the end portion of the car unobstructed.

It is another object of the present invention to avoid the step of lowering the end liner and offset of the end into alignment with a vertical extension of the end sill.

It is another object of the present invention to avoid the problem of misaligned drilled and/or countersunk holes in the end structure of the car after the vertical extension has been placed within the opening defined by the liner and offset end portion.

Another object of the present invention is to avoid an integral end and end sill construction.

Another object of the present invention is to provide a fabrication technique which is less expensive than prior techniques.

Other objects will be apparent from the drawings and the following description.

Summary of the Invention

A box car end is provided having an offset portion. A flat end liner is affixed to the end on the side opposite the offset portion. The assembled liner and end are placed in engagement with an end sill having a horizontal portion extending inwardly toward the car and a vertical extension at the end thereof. The offset portion is integrally affixed to the end sill vertical extension, preferably with mechanical fasteners. A floor support is integrally affixed to the horizontal portion of the end sill. The floor support has a horizontal portion supporting a portion of the car floor and an upper vertical portion providing an unobstructed end area on the inside of the car. The upper vertical portion of the floor support may be integrally affixed, preferably by welding to either the end and/or the end liner, preferably above the offset portion.

THE DRAWINGS

DESCRIPTION OF PREFERRED EMBODIMENTS

Figure 5:
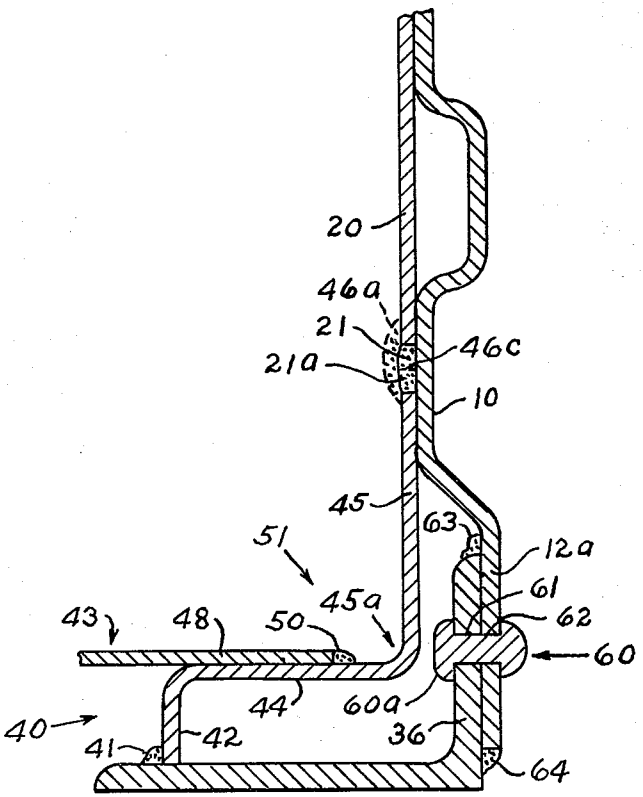
FIG. 5 is a view of the box car end construction of the present invention also looking at the side of the car near the end thereof.
Figure 4:
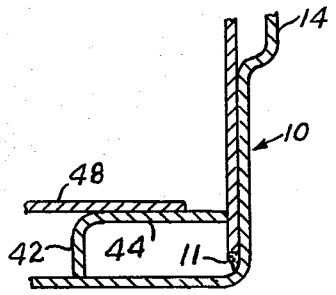
FIG. 4. PRIOR ART
FIG. 4 is a view of an alternative prior art construction also looking at the side of the car near the end thereof.
Figure 3:
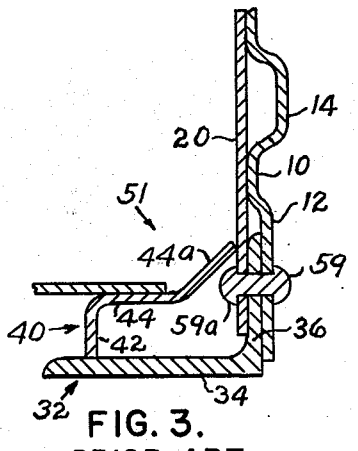
FIG. 3. PRIOR ART
FIG. 3 is a view of an alternative prior art construction also looking at the side of the box car near the end thereof.
Figure 1:
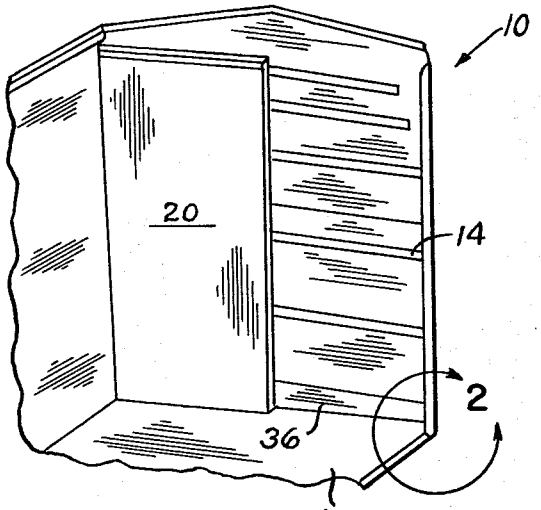
FIG. 1. PRIOR ART
FIG. 1 is an exploded perspective view of a box car.
Figure 2:
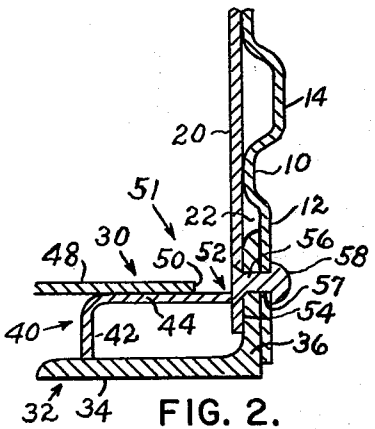
FIG. 2. PRIOR ART
FIG. 2 is a view along the lines 2—2 in FIG. 1 illustrating a prior art construction and method of assembly.

In accordance with the present invention, as shown in FIG. 5, an offset 12*a* is provided in end member 10. Further, a flat end liner 20 is foreshortened as indicated at 21 and is affixed, preferably by welding to the end as indicated at 21*a*.

In order to engage the end assembly of liner 20 and end 10 it is merely necessary to provide longitudinal relative movement until the end assembly engages the vertical extension 36 of end sill 32. Then offset portion 12*a* is affixed to end sill extension 36. This is preferably done by fasteners 60 of any desired type may be utilized to hold the end assembly in engagement with the end sill extension along the end of the car. For example, these fasteners may comprise huck bolts, heavy duty screws, etc. Holes 61 and 62 respectively in extension 36 and offset portion 10 are preferably pre-drilled or they may be drilled after the offset and extension have been placed together. No recountersinking or rework is required.

The extent of offset 12*a* is sufficient to provide space for vertical extension 36 and the head of fasteners 60 without interference with the upper vertical portion of 45 of floor support 40 (described hereinafter).

The use of fasteners 60 enables the end structure to be readily disassembled, if desired. For example, in the event of damage to some part of the end.

However, if desired, the offset portion 12a may be welded to vertical extension 36 either on the inside of the end as shown at 63 and/or on the outside of the end as shown at 64. Such welding may be done in addition to or instead of the use of fasteners 60. If welding is used it is a harder and more time consuming job to disassemble the end, for example, by burning off the welds with a torch. If welding only is used, the offset does not necessarily have to be large enough to allow for fastener heads 60*a*. It will be apparent that the construction of the present invention provides considerable flexibility in affixing the end to the end sill extension.

After the offset portion is in place, the floor panel support 40 is affixed to the end sill, for example, by welding at 41. In addition to a lower generally vertical portion 42, support 40 is provided with a second generally vertically extending portion 45 with a substantially 90° bend indicated at 45*a*. Vertical portion 45 is affixed with mechanical fasteners or welding to end 10 and/or liner 20 (shown dotted) as indicated at 46 and 46*a* respectively. If desired, any gap between the lower end of liner 20 and the upper termination point of upper vertical portion 45 may be filled with weld deposits 46c and ground to provide a smooth surface. The second vertical extension 45 of the floor panel support provides a smooth and unobstructed end area 51 to avoid damage to the lading and/or difficulties in stacking the same. If desired, nailable steel flooring 43 having a floor panel 48 may then be put in place and is welded (or affixed with fasteners) to the horizontal portion 44 of the floor panel support as indicated at 50.

It will thus be apparent that the present invention has the following advantages. First, the liner and end assembly may be moved longitudinally into engagement with the end sill vertical extension 36. It does not have to be lowered upon the extension, and thus this difficult and sometimes dangerous alignment operation is eliminated. Secondly, the problem of misalignment of drilled and/or countersunk holes and the rework necessary to correct the misalignment is avoided in accordance with the present invention. Conventional fasteners may be utilized and countersunk holes are not required. If desired, in addition to or as a substitute mechanical fastener, the offset may be welded to the end sill extension. Thirdly, there is no blocking or obstruction of the end area of the box car to cause damage to the lading and/or stacking problem. The use of conventional fasteners instead of huck bolt means result in a small cost saving. If only fasteners have been used to hold the end in engagement with the end sill, in the event of damage to the car, the end structure can be relatively easily separated from the end sill by removing only the fasteners 60. Thus, customers who want this option can have it in accordance with the design of the present invention. Finally, the construction of the present invention provides a significant saving in labor cost on a unit car basis.

I claim:

1. A method of assembling a box car end structure comprising the following steps in the sequence indicated:

1. providing a box car end having an offset on one side thereof;
2. welding thereto a flat end liner on the side of said end opposite to said offset;
3. providing longitudinal relative movement between the welded end and end liner assembly and a box car end sill having a horizontal portion and a vertical extension such that the offset portion of said end engages said vertical extension;
4. integrally affixing said offset portion to said vertical extension with mechanical fasteners having a head thickness less than the extent of said offset;
5. welding to the horizontal portion of said end sill a floor support member having a horizontal portion adapted to support a floor panel and having an upper vertical portion adapted to provide a smooth and unobstructed end portion of the box car, and
6. welding the upper vertical portion of said floor support to said box car at a point on said box car end above said offset.

2. A method according to claim 1 wherein said floor support is provided with a lower vertical portion which is welded to the horizontal portion of said end sill.

3. A method of assembling a box car end structure according to claim 2 including integrally affixing a floor panel to said floor support.

4. A method according to claim 2 wherein said upper vertical portion of the floor support is welded to said box car end adjacent the termination point of said end liner.

5. A method according to claim 4 wherein any gap between said end liner and the vertical extent of said floor panel support is filled with weld material.

6. A method according to claim 5 wherein said weld material is ground smooth to provide a generally smooth vertical box car end.

* * * * *